US006712990B1

(12) United States Patent
Phule

(10) Patent No.: US 6,712,990 B1
(45) Date of Patent: Mar. 30, 2004

(54) MAGNETORHEOLOGICAL FLUIDS AND RELATED METHOD OF PREPARATION

(75) Inventor: Pradeep P. Phule, Pittsburgh, PA (US)

(73) Assignee: University of Pittsburgh of the Commonwealth System of Higher Education, Pittsburgh, PA (US)

( * ) Notice: Subject to any disclaimer, the term of this patent is extended or adjusted under 35 U.S.C. 154(b) by 33 days.

(21) Appl. No.: 10/172,623

(22) Filed: Jun. 14, 2002

(51) Int. Cl.[7] ..... H01R 1/22
(52) U.S. Cl. ..... 252/62.52
(58) Field of Search ..... 252/62.52

(56) References Cited

U.S. PATENT DOCUMENTS 4,992,190 A * 2/1991 Shtarkman ..... 252/62.52
5,578,238 A 11/1996 Weiss et al.
5,645,752 A * 7/1997 Weiss et al. ..... 252/62.54
5,667,715 A 9/1997 Foister
5,985,168 A 11/1999 Phule
6,149,832 A * 11/2000 Foister ..... 252/62.52

OTHER PUBLICATIONS

Barry Arkles, Commericial Applications of Sol–Gel–Derived Hybrid Materials, May 2001, pp. 402–407, MRS Bulletin.

* cited by examiner

*Primary Examiner*—C. Melissa Koslow
(74) *Attorney, Agent, or Firm*—Debra Z. Anderson; Arnold B. Silverman; Eckert Seamans Cherin & Mellott, LLC

(57) ABSTRACT

Magnetorheological (MR) fluids, dispersions of magnetically soft particles in fluids (gases, liquids, or semi-solids such as greases), are disclosed. The present invention uses the initial steps of a sol-gel process to assist in preparation of MR fluids that have significantly enhanced stability and redispersibility, without the use of ceramic particles such as silica or bridging polymers such as PVP.

11 Claims, No Drawings

MAGNETORHEOLOGICAL FLUIDS AND RELATED METHOD OF PREPARATION

GOVERNMENT CONTRACT

This work was supported in part by the National Science Foundation under Contract No. CMS-9817578.

FIELD OF THE INVENTION

Magnetorheological (MR) fluids are disclosed. The present invention uses the initial steps of a sol-gel process to assist in preparation of magnetorheological fluids that have significantly enhanced stability and redispersibility

BACKGROUND INFORMATION

Most magnetic metal and ceramic powders used in preparation of magnetorheological (MR) fluids and other applications actually have a surface that is not pure metallic or ceramic. The presence of oxygen and hydrogen on the surface of metal or ceramic powders is not unexpected. Many otherwise pure or nearly pure metals are expected, based on their thermodynamic tendency and kinetics of chemical reactions, to undergo chemical corrosion when they are exposed to atmospheres that contain oxygen gas (e.g. air). Similarly, the surface of ceramic particles can be hydroxylated. This observation has been documented in the prior art.

Iron powders have been used for formulating many MR fluid compositions that have practical applications in devices such as dampers, clutches, and brakes. The surface of most iron powders comprises metallic iron and thin layers of an oxide like material. The x-ray photoelectron spectra for various types of iron powders show that, in addition to metallic iron, the surface (probably a few nanometers of the surface region) also consists of oxygen and hydrogen (probably in form of oxygen ions and hydroxyl ions). The exact form of chemical species and their concentration is very difficult to measure. Many MR fluids have been developed which take advantage of the hydrogen-bonding ability of the surface species.

U.S. Pat. No. 5,645,752 (Weiss, et al.) discloses the use of ultrafine oxide materials such as silica whose surface has been modified with a polymer, such as siloxanes. The surface modified oxide particles are added to the magnetic particles and form, through hydrogen bonding, a thixotropic network that helps minimize settling.

U.S. Pat. No. 5,578,238 (Weiss, et al.) discloses MR materials utilizing surface modified particles; surface contaminants are removed so as to improve the magnetic performance of the MR fluids. This is done by an abrader or chemical treatment.

U.S. Pat. No. 5,667,715 (Foister) and U.S. Pat. No. 6,149,832 (Foister) disclose MR fluids comprising solid magnetic particles in which a portion of the volume fraction of the particles is comprised of relatively large particles and a second portion of the volume fraction is comprised of relatively small particles. The carrier fluids disclosed are polyalphaolefins and glycol esters, highly non-polar fluids which ensure that the carbonyl iron particles form hydrogen bonds with other particles and not with any hydrogen in the fluid.

See also the inventor's prior patent, U.S. Pat. No. 5,985,168, expressly incorporated herein by reference.

There is a continued need for the development of MR fluids having improved dispersability.

SUMMARY OF THE INVENTION

The present invention solves the above need by making use of the surface species found on the magnetic particles, in contrast to prior art methods in which these are viewed as contaminants. The invention provides an magnetorheological (MR) fluid comprising soft magnetic particles having a surface that is or can be hydroxylated, a sol-gel precursor that is capable of inducing sol-gel and cross-condensation reactions with the surface of the magnetic particles, and a carrier liquid.

The MR fluids of the present invention have better redispersibility, through the use of the sol-gel process, to produce stable magnetorheological (MR) fluids. This is accomplished through the use of precursors to chemically alter the naturally occurring surface of the magnetic material. No cleaning of particle surfaces (as recommended in the Weiss Patent (U.S. Pat. No. 5,578,238)) is necessary. The interaction involves formation of a covalent bond between the precursor and magnetic particle. Once such a reaction occurs, the precursor is essentially incapable of forming additional hydrogen bonds, in contrast to prior art methods that disclose hydrogen bond formation between the chemicals or particles added. The sol-gel precursors used in the fluids of the present invention do not form a thixotropic network.

It is an object of the present invention, therefore, to provide a stable magnetorheological fluid using the sol-gel process.

It is a further object of the present invention to provide a stable magnetoreheological fluid that does not use hydrogen bonding to maintain dispersibility of the metal particles.

These and other objects of the present invention will become more readily apparent from the following drawing, detailed description and appended claims.

DETAILED DESCRIPTION OF PREFERRED EMBODIMENTS

The present invention provides an magnetorheological (MR) fluid comprising particles of a soft magnetic material, a sol-gel precursor and a carrier liquid. Typically, the soft magnetic material will comprise about 20–98 wt. % of the fluid, more preferably 50–98 wt. % of the fluid. The sol-gel precursor will comprise about 1–20 wt. % of the fluid, more preferably 5–10 wt. %. The balance of the fluid will be the liquid carrier.

The magnetic particles must have a surface that is or can be hydroxylated, as described more fully below. In accordance with the present invention, suitable magnetically soft particles of the MR fluid may comprise iron, carbonyl iron, nickel, cobalt, iron oxide, gamma iron oxide, iron cobalt, iron nickel, iron silicon, manganese zinc ferrite, zinc nickel ferrite, chrome oxide, iron nitride, vanadium alloys, tungsten alloys, copper alloys, manganese alloys, and any other suitable magnetically soft particles. As used herein, the term "soft" refers to particles that do not retain high levels of magnetization (e.g., >10 emu/gm) after the magnetic field is removed. The soft magnetic particles typically have an average particle size from about 1 to about 100 microns, preferably from about 1 to about 20 microns. A preferred magnetic powder is carbonyl iron.

Because the surface of most magnetic materials is hydroxylated, it is possible to use the sol-gel process to cause desirable chemical reactions with the surface species present on surfaces of magnetic materials such as iron powders. Such sol-gel chemical reactions can be used to further enhance the redispersibility of MR fluids.

There are at least two types of sol-gel processes. One type of sol-gel process is the so-called colloidal sol-gel process and the other is known as the polymeric sol-gel process. The chemical basis for the polymeric sol-gel process is similar to the well-known addition or condensation polymerization process.

The sol-gel precursors of the present invention are those precursors that can induce sol-gel reactions and cross-condensation reactions with the surface of the magnetic particles. Suitable precursors include metal alkoxides, arid are discussed here simply to illustrate the principles of the sol-gel process. In practice, any sol-gel precursors, that are capable of undergoing these reactions, can be used. Examples of suitable precursors include, but are not limited to, metal alkoxides, metal diketonates, siloxanes, silicones terminated with hydrolyzed or hydrolyzable functionalities, colloidal metal oxides, hydroxides and carbonates containing one or more metals. Preferred are silicones terminated with a hydroxyl or alkoxy group. Examples of suitable colloidal metal oxides include, but are not limited to, silica, titania, zirconia, alumina, and antimony oxide. The reaction of these species occurs via hydrolysis of the hydrolyzable moiety (e.g. M—OR, where M represents the metal particle, and R represents lower alkyl groups, linear or branched, preferably from 1 to about 4 carbons, although there is no strict limit to the length of the carbon chain) and polycondensation reactions involving the resulting M—OH group. Water acts as the "initiator" and is usually externally added. Water can also be generated in situ by condensation reactions such as the formation of esters by the condensation of carboxylic acids and alcohols. Acids or bases can be used as catalysts for these reactions. In some cases the precursors may already be partially or fully hydrolyzed. If the polycondensation reactions are allowed to occur to a significant extent, the original sol can transform into a gel. Formation of a gel, however, is not necessary to derive the benefits of this invention.

The reaction of metal alkoxides (used here only as a convenient way of discussing the chemical principles) with water is known as the hydrolysis reaction (Equation 1):

$$M(OR)_x + x\ H_2O \rightarrow M(OH)_x + x\ ROH \quad (1)$$

Where x is the valence of the cation M and R is as described above.

Equation (1) represents a complete hydroxy-alkoxy exchange; that is, all the alkoxy groups have been shown to be replaced by hydroxy groups. Those skilled-in-the-art will recognize that the alkoxy functionality can be replaced with other organic groups capable of showing similar reactions. The exchange between the hydrolysable group and hydroxy group may or may not occur completely depending on the relative concentration of water and other conditions. The partial hydrolysis can be represented by the following reaction:

$$M(OR)_x + y\ H_2O \rightarrow M(OH)_y(OR)_{x-y} + y\ ROH \quad (2)$$

Where x is the valence of the cation M, y is the number of moles available for the hydrolysis reaction, and R is a lower alkyl group linear or branched, preferably 1 to about 4 carbons, as described above.

One of the implications of the hydrolysis reaction is that proper care must be taken in handling, packaging, and using metal alkoxides. Even traces of moisture are often sufficient to cause pre-hydrolysis and often undesirable precipitation of hydroxides.

The next step is the condensation reactions represented below:

$$M—OR + M—OH \rightarrow M—O—M + R—OH \quad (3)$$

$$M—OH + M—OH \rightarrow M—O—M + H—OH \quad (4)$$

In equations 3 and 4 the remaining functionalities on the metal cations are not shown. Reaction 4 also can be used to describe network formation between hydroxyl-functional, colloidal metal oxide precursors. Thus metal-oxygen-metal (M—O—M) covalent bonds can form during the condensation reactions that occur using either polymeric (monomeric, oligomeric, and the like) alkoxide or colloidal oxide precursors. These reactions ultimately lead to the formation of a network consisting of metal-oxygen bonds. An important feature of these reactions is that they can occur at low temperatures (~<100° C.). This is one of the reasons metal alkoxides and colloidal oxide particulates represent the precursors of choice for gel processing of oxide ceramics and glasses. Cross-condensation reactions i.e. reactions between species from two or more cations (Equations 5, 6), are also possible.

$$M^1(OR) + M^2(OH) \rightarrow M^1—O—M^2 + R—OH \quad (5)$$

$$M^1(OH) + M^2(OH) \rightarrow M^1—O—M^2 + H—OH \quad (6)$$

It is possible to conduct only the initial stages of the sol-gel reactions i.e. only the hydrolysis and some cross-condensation reactions between certain precursors such as metal alkoxides or other suitable precursors and the surfaces of iron powders. The result of such chemical reactions is formation of strong, covalent chemical Fe—O—P bonds (Equations 7 and 8).

$$P\ (OR) + Fe(OH) \rightarrow P—O—Fe + R—OH \quad (7)$$

$$P(OH) + Fe(OH) \rightarrow P—O—Fe + H—OH \quad (8)$$

In equations 7 and 8 it is to be recognized that the symbol P represents the precursor element. The symbol Fe also represents the rest of the magnetic Fe particle. A clear advantage of using these sol-gel chemical reactions is that one can form covalent bonds that are very stable even at high temperatures due (up to about 700° C.) to high bond energies. It is thought that these bonds between the sol-gel precursors and the particles of the magnetic materials used render the MR fluids relatively redispersible, although the inventor does not wish to be bound by this. Many prior art methods use additives and chemicals to promote hydrogen bonds between the particles or between the surfaces of the magnetic particles. Hydrogen bonds have very low energies and will be disrupted at higher temperatures (See Table 1 below, for approximate bond energies; see also U.S. Pat. Nos. 5,667,715 and 5,645,752). In contrast, the use of the sol-gel reactions of the present invention results in chemical bonds that are covalent in nature, providing an improved fluid for applications involving higher temperatures. While not wishing to be bound by any theory, the stability at higher temperatures is thought to be due to the sol-gel reactions occurring on the surfaces of the magnetic particles. The sol-gel reactions may also provide additional benefits such as corrosion and oxidation protection.

TABLE 1

| Type of Bond | Bond Energy (kcal/mole) |
|---|---|
| Ionic | 150–370 |
| Covalent | 125–300 |
| Metallic | 25–200 |
| Van der Walls | <10 |

From: Askeland and Phulé, *The Science and Engineering of Materials*, Fourth Edition (2002) (In Print)

According to the present invention, it is not necessary to complete the sol-gel reactions i.e. the formation of a thixotropic gel or a three-dimensional network; the important aspect is the very early stages of the sol-gel reactions.

The scope of the present invention is not limited to the use of iron powders and certain carrier liquids. To obtain the benefit of the present invention, it is not necessary to start with sol-gel precursors and conduct the initial steps causing the hydrolysis reactions. The benefits of this invention can also be realized utilizing sol-gel precursors that have been pre-hydrolyzed and simply making use of the chemical cross-condensation reactions. The pre-hydrolyzed sol-gel precursors may be beneficial in that their use may avoid the addition of water. Also, the precursors do not have to be polymeric; they can be colloidal in nature as long as they have a functionality that is capable of reacting with the surface of the magnetic particles Similarly, the benefits of this invention can also be realized not only by using iron powders but also any suitable soft magnetic material such as Ni, Fe—Co alloys, and ceramic ferrites, as long as the surface of the material is or can be hydroxylated.

The present MR fluids also possess favorable magnetic properties. Under no magnetic field, the MR fluids typically have a yield stress of from about 0.1 kPa to about 1 kPa. When the MR fluid is introduced into a magnetic field (e.g., B=1 Tesla), its yield stress typically increases to a level of greater than about 0.2 kPa, preferably from about 2 to about 100 kPa. The MR fluid preferably undergoes an increase in yield stress on the order of at least about 100 times when subjected to a magnetic field. The magnetically soft particles are substantially uniformly redispersible in the solvent after a magnetic field is removed from the fluid.

The improvement expected in redispersibility of MR fluids will depend on the relative ratio of the hydroxyl groups on the surface of the magnetic material and the extent to which the sol-gel reactions can be conducted. The carrier liquid vehicle for the fluids can be any suitable carrier liquid including, but not limited to, water, synthetic oil liquids, silicone liquids, mineral oils, kerosene, glycol ethers, ethylene glycol, polyethylene glycol, propylene glycol, derivatives of these compounds, just to name a few. Preferred are silicone oils and synthetic oils. The MR fluid compositions prepared in accordance with this invention can also optionally contain (in addition to the sol-gel precursors, carrier liquids, and magnetic particles) other liquids, solvents, co-solvents, wetting agents, surfactants, lubricating agents, polymers, anti-oxidants, colloidal particles, low molecular weight polymers, corrosion or rust inhibitors, solvents, anti-settling agents, pH control agents and other suitable materials. The purpose of their use may be to further enhance the relative performance of the MR fluids.

EXAMPLES

The following examples are intended to illustrate the invention and should not be construed as limiting the invention in any way.

Example 1

Procedure for 100 cSt Based MR Fluid

A 40 volume percent (84.4 weight percent) iron-based MR fluid in accordance with the present invention is prepared as follows. Iron powder 312.0 gr (Grade S-3700 micropowder manufactured by ISP Technologies Inc.) having an average particle size of about 1–3 micrometers is dispersed in 52.8 gr of polydimethylsiloxane (PDMS-100 cSt) as the carrier fluid. It may be possible to use other carrier liquids and iron powders as well. The carrier fluid also contains 1.3 weight percent of hydroxy terminated polydimethylsiloxane (PDMS-OH). It is also possible to use alkoxy and other functionalities for the termination, as long as they can be hydrolyzed to form a chemical group that can form a chemical bond with the iron particle surface. The use of pre-hydrolyzed precursors, such as the one used here in this example, saves time. The calculated masses of the powders and solvent are weighed using an Ohaus Model CT1200 digital scale. The solvent along with the PDMS-OH is then added to a 250 ml Nalgene container. The container is then placed in a clamp on a ring stand and adjusted so that the blades of the General Signal Lightning L1U10 mixer are as close to the bottom of the container as possible without touching it. The mixer speed is set at 600 rpm and the mixture stirred for 2 minutes. The mixer speed is then increased to 800 rpm and the powder is slowly added to the solvent. Once all the powder is added the mixer speed is increased to 1000 rpm and the resultant mixture stirred for 10 minutes. After thorough mixing, 160 grams of yttria-stabilized zirconia grinding media is added to the MR fluid, and then the container is sealed. The Nalgene bottle is then placed on a ball mill for 24 hours in order to reduce any particle agglomeration and to homogenize the sample. Following the ball milling, the grinding medium is separated from the MR fluid using a mesh screen.

Example 2

Procedure for 5 cSt Based MR Fluid

This example illustrates preparation of a MR fluid that may have a lower viscosity at higher steady state shear rates. A 40 volume percent (85 weight percent) iron-based MR fluid in accordance with the present invention is prepared as follows. Iron powder 312.0 gr (Grade S-3700 micropowder manufactured by ISP Technologies Inc.) having an average particle size of about 1–3 micrometers is dispersed in 50.22 gr of polydimethylsiloxane (PDMS-5 cSt) as the carrier fluid. Care has to be taken to minimize and account for the evaporation of lower viscosity carrier liquids. It may be possible to use other carrier fluids and iron powders as well. The carrier fluid also contains 1.3 weight percent of hydroxy terminated polydimethylsiloxane (PDMS-OH). It is also possible to use alkoxy and other functionalities for the termination, as long as they can be hydrolyzed to form a chemical group that can form a chemical bond with the iron particle surface. The use of pre-hydrolyzed precursors, such as the one used here in this example, saves time. The calculated masses of the powders and solvent are weighed using an Ohaus Model CT1200 digital scale. The solvent along with the PDMS-OH is then added to a 250 ml Nalgene container. The container is then placed in a clamp on a ring stand and adjusted so that the blades of the General Signal Lightning L1U10 mixer are as close to the bottom of the container as possible without touching it. The mixer speed is set at 600 rpm and the mixture stirred for 2 minutes. The mixer speed is then increased to 800 rpm and the powder is slowly added to the solvent. Once all the powder is added the mixer speed is increased to 1000 rpm and the resultant mixture stirred for 10 minutes. After thorough mixing, 160 grams of yttria-stabilized zirconia grinding media is added to the MR fluid, and then the container is sealed. The Nalgene bottle is then placed on a ball mill for 24 hours in order to reduce any particle agglomeration and to homogenize the sample. Following the ball milling, the grinding medium is separated from the MR fluid using a mesh screen.

Whereas particular embodiments of this invention have been described above for purposes of illustration, it will be evident to those skilled in the art that numerous variations of the details of the present invention may be made without departing from the invention as defined in the appending claims.

What is claimed is:

1. An magnetorheological fluid comprising particles of a soft magnetic material, a sol-gel precursor and a carrier liquid, said sol-gel precursor being capable of forming a bond with said particle surface.

2. The magnetorheological fluid of claim 1 wherein the magnetic material comprises about 20–98 wt. % of the fluid, the sol-gel precursor comprises about 1–20% wt. % of the fluid, and the balance of the fluid being carrier liquid.

3. The magnetorheological fluid of claim 1, wherein said magnetic material comprises carbonyl iron.

4. The magnetorheological fluid of claim 3, wherein the carrier liquid is silicone oil.

5. The magnetorheological fluid of claim 3, wherein the carrier liquid is synthetic oil.

6. The magnetorheological fluid of claim 1, wherein said sol-gel precursor is colloidal.

7. The magnetorheological fluid of claim 1, wherein said sol-gel precursor is polymeric.

8. The magnetorheological fluid of claim 6, wherein said colloidal sol-gel precursors are selected from the group consisting of silica, titania, zirconia, alumina and antimony oxide.

9. The magnetorheological fluid of claim 7, wherein said polymeric sol-gel precursor is a silicone terminated with a hydroxy or alkoxy group.

10. The magnetorheological fluid of claim 1, further comprising lubricants and rust inhibitors.

11. The magnetorheological fluid of claim 1, wherein at least a portion of the surface of said magnetic particles is in a hydrolyzed state.

* * * * *